US006869349B2

(12) United States Patent
Lundum

(10) Patent No.: US 6,869,349 B2
(45) Date of Patent: Mar. 22, 2005

(54) ABRADING MACHINE WITH ABRADING DISCS, WHICH ARE MOVED IN A RECIPROCATORY MOVEMENT TRANSVERSE TO AN ITEM

(75) Inventor: Poul Lundum, Hadsten (DK)

(73) Assignee: Slipcon Holding International ApS (DK)

( * ) Notice: Subject to any disclaimer, the term of this patent is extended or adjusted under 35 U.S.C. 154(b) by 0 days.

(21) Appl. No.: 10/807,853

(22) Filed: Mar. 24, 2004

(65) Prior Publication Data

US 2004/0180613 A1 Sep. 16, 2004

Related U.S. Application Data

(63) Continuation-in-part of application No. 10/257,482, filed on Oct. 10, 2002.

(30) Foreign Application Priority Data

May 12, 2003 (DK) ..... 2003 00722

(51) Int. Cl.[7] ..... B24B 9/10

(52) U.S. Cl. ..... 451/490; 451/464; 451/469; 51/330; 51/334

(58) Field of Search ..... 451/464, 271, 451/466, 469, 490; 51/330, 331, 332, 334

(56) References Cited

U.S. PATENT DOCUMENTS

| | | | | |
|---|---|---|---|---|
| 3,139,641 A | | 7/1964 | Grogan et al. | |
| 3,747,285 A | | 7/1973 | Block | |
| 4,183,183 A | | 1/1980 | Belanger | |
| 4,217,737 A | | 8/1980 | Hasegawa | |
| 4,228,617 A | * | 10/1980 | Bando | 451/5 |
| 4,251,958 A | | 2/1981 | Langenberg et al. | |
| 4,275,529 A | | 6/1981 | Teetzel et al. | |
| 4,285,171 A | | 8/1981 | Block et al. | |
| 4,375,738 A | * | 3/1983 | Bando | 451/4 |
| 4,493,170 A | | 1/1985 | Hanger | |
| 4,704,823 A | * | 11/1987 | Steinback | 451/261 |
| 4,872,292 A | | 10/1989 | Block | |
| 4,882,879 A | | 11/1989 | Warner et al. | |
| 4,969,299 A | | 11/1990 | Block | |
| 5,318,603 A | | 6/1994 | Scheider et al. | |
| 6,200,206 B1 | | 3/2001 | Drees | |
| 6,217,124 B1 | | 4/2001 | Jespersen | |
| 6,217,431 B1 | | 4/2001 | Brinkmann | |
| 6,267,660 B1 | | 7/2001 | Jespersen | |
| 2003/0092359 A1 | * | 5/2003 | Pedrini | 451/5 |

FOREIGN PATENT DOCUMENTS

| | | |
|---|---|---|
| DE | 24 11 749 | 9/1975 |
| DK | 171364 | 9/1996 |
| EP | 0 922 535 | 6/1999 |
| WO | WO 97/35688 | 10/1997 |
| WO | WO 01/76824 | 10/2001 |

* cited by examiner

*Primary Examiner*—Joseph J. Hail, III
*Assistant Examiner*—Anthony Ojini
(74) *Attorney, Agent, or Firm*—Cantor Colburn LLP

(57) ABSTRACT

An abrading machine is disclosed for abrasion of substantially plane items by use of rotating abrading discs, which are moved simultaneously forwards and backwards transverse to the item and which preferably has downward extending abrasive lamellae. The machine also preferably includes one, typically two, opposite rotating abrading cylinders fitted with elongated abrasive elements radially mounted on the abrading cylinder and has abrasive lamellae extending outwards from the cylinder. By moving the abrading discs in a reciprocatory movement transverse to the direction of feed of the items it is achieved that traces etc. from the different abrasive properties of the abrading discs are eliminated as well as all parts of milled out areas etc. are evenly abraded, particularly if the abrading device is designed for using abrading discs with abrasive means comprising abrasive lamellae made of abrasive cloth and which extend downwards from the face of the abrading disc.

32 Claims, 7 Drawing Sheets

ABRADING MACHINE WITH ABRADING DISCS, WHICH ARE MOVED IN A RECIPROCATORY MOVEMENT TRANSVERSE TO AN ITEM

CROSS REFERENCE TO RELATED APPLICATION

This application is a continuation-in-part of U.S. patent application Ser. No. 10/257,482, filed 10 Oct. 2002, which is herein incorporated by reference in its entirety.

TECHNICAL FIELD OF INVENTION

The invention relates to an abrading machine for abrasion of substantially plane items using rotating abrading discs, which simultaneously reciprocate, i.e. move forwards and backwards, transverse to the item and preferably has downwardly extending abrasive lamellae.

It is preferred that the machine also comprises one, typically two, counter rotating abrading cylinders equipped with elongated abrasive elements, which are radially mounted on the abrading cylinder with the abrasive lamellae extending radially from the cylinder.

BACKGROUND OF THE INVENTION

For abrasion of items with a plane surface an abrasive belt is often used, which is mounted on a belt sander. However, this abrading method is only suitable for abrasion of completely plane surfaces, as carvings in or other shapings of the surface will be "smoothed out" and the lowered surface will not be abraded by the abrasive belt. At the same time, the exactness of the abrasion is thereby not satisfactory in relation to many abrading tasks. This means that this abrading method is unsuitable for many abrading tasks within, e.g., the furniture industry where a gentle but at the same time complete abrasion is required. Similar problems with performing a complete deburring and abrasive or polishing surface treatment in connection with cut-out, milled out and laser-cut items are known from the metal industry as well as in production and surface processing of so-called "solid surface" items.

Within, among others, the production of furniture many different abrasion tasks depend on the size and shape of the item. Within the last decades, a considerable automation of the production of wood products has taken place within, among others, the furniture industry, which also makes new demands on the abrading tools. In, among others, WO 01/76824 and U.S. Pat. No. 6,267,660 (which are both herein incorporated by reference in their entirety), a rotating abrading tool is described in the form of a roll with abrasive elements, a so-called abrading cylinder, which is suitable for abrasion of profiled or plane items. Here, the plane item is conveyed through the abrading device on a conveyor belt, a trolley or the like in a continuous movement. The roll is brought to rotate about its longitudinal axis and the rotating abrading tool is brought into contact with the surface, whereby a gentle abrasion may take place. This abrasive method is gentle due to a low abrasive pressure but it may be a slow abrasive process in relation to abrasive tasks on a general plane face having shapings, e.g., a door. In this case, it is necessary to move the abrading tool in a complicated movement around along the shapings to ensure a complete abrasion of these. In this connection it is also of great importance which rotational direction the abrading tool has in relation to the profile curves. The result is that the conduction of the abrasive task becomes slow and at the same time may be difficult to fully automate which also makes the tool inefficient seen from a production cost view.

Thus, to achieve an efficient working procedure at abrasion of items with shapings or other carvings in a substantially plane surface, it may be necessary to apply belt abrasion for the plane faces and a rotating abrading tool for the shaping areas, where the abrading tool is moved about along the shapings.

BRIEF SUMMARY OF THE INVENTION

Thus, the present invention achieves an abrading device which complies with the disadvantages of the known techniques as described above by enabling an efficient, simultaneous and uniform abrasion or processing of an item's surface.

By the present invention an abrading device for abrasion of substantially plane items is provided, said device comprising means for conveyance of the items in a direction of feed, suspension means for suspension of a plurality of abrading discs for abrasion of a side of the items, means for driving rotation of the abrading discs around axes being substantially perpendicular on the side of the items, and means for driving the abrading discs in a reciprocatory movement transverse to the direction of feed of the items. By moving the abrading discs in an oscillatory or reciprocatory movement transverse to the direction of feed of the items it is achieved that traces etc. from the different abrasive properties of the abrading discs across the diameter of the disc are eliminated as well as all parts of milled out areas etc. are abraded evenly, especially if the preferred abrading device is arranged to apply abrading discs with abrasive means which comprise abrasive lamellae of an abrasive sheet, such as abrasive cloth where the surface of which has abrasive properties and which extends from the face of the abrading disc. Such abrading discs are, e.g., described in U.S. Pat. No. 4,493,170, in DE-A-24 11 749 and in EP-A-0 922 535, all of which are incorporated herein by reference in their entirety.

The present invention relates to an abrading device for abrasion of substantially plane items, said device comprising means for conveyance of the items in a direction of feed, suspension means for suspension of a plurality of abrading discs having abrasive means for abrasion of a side of the items, means for driving rotation of the abrading discs around axes, which are substantially perpendicular to the side of the items, and means for driving the abrading discs in a reciprocatory movement transverse to the direction of feed of the items.

The suspension means for suspension of the abrading discs is preferably made as one single structure so that the reciprocatory movement of all the abrading discs can be driven by the same drive means. This or these means may typically be an electrical or hydraulic motor, which drives rotation of an axis with an eccentric attachment to the suspension means but may, e.g., instead consist of an elastic suspension of the suspension means and a solenoid which is turned on and off at a given frequency by a relay, thus performing regularly changing forces between the suspension means and a stationary part of the abrading device.

This reciprocatory movement transverse to the direction of feed of the items is preferably a substantially strictly transverse movement but may also, e.g., comprise a circular or elliptical shaped movement of the abrading discs as long as the movement pattern includes said reciprocatory movement. The reciprocatory movement of the abrading discs has in one embodiment preferably a length of stroke of 40–100%, preferably 60–85%, of the diameter of the discs to eliminate the tendency to groove formation. By length of stroke is understood the distance between the two extreme positions in transverse direction of the center axis of an abrading disc.

It is preferred that the suspension means are arranged for suspension of abrading discs with abrasive means, which extend from the face of the abrading disc in as much as such abrading discs, as, e.g., known from U.S. Pat. No. 4,493,170, from DE-A-24 11 749 and from EP-A-0 922 535, are particularly suitable for abrasion of lowerings in the surface such as milled out areas or perforations. According to the invention, the device may, however, also comprise abrading discs with plane abrasive means such as a yielding disc mounted with an abrasive ring of abrasive paper or abrasive cloth, which may vary in hardness depending on the task.

The abrading device may advantageously comprise a plurality of abrading discs with undercut grooves for reception and fixing of profile rails which form a part of elongated abrasive elements comprising abrasive means, said grooves preferably extend in a mainly radial direction on the face of the abrading disc. Thereby, the abrading discs can receive elongated abrasive elements which consist of abrasive means in the form of lamellae of abrasive cloth of which the front side has abrasive properties and the back side is supported by support elements being elastic in the tangential direction of the disc, so that the front side of the abrasive cloth is pressed into abutment with a relatively high abrasive pressure with the surface to be abraded and thus the abrasion can take place at low feed velocity of the abrasive element, i.e. low rotational speed of the abrading disc, in order to prevent strokes at the point between faces and profiles and partly in order to keep the front side of the abrasive cloth in continuous contact with the surface of the item to be abraded, which results in a uniform and complete abrasion. The support elements are preferably brushes, e.g., natural brushes, which extend from the face of the disc in a shorter distance than the abrasive means so that the support elements are not normally in contact with the item. The abrasive means and support elements are secured in a profile rail with a cross section corresponding to the cross section of the grooves such that the abrasive elements are easily pushed into and retained by the grooves and also easily removed from them whereby a replacement of worn abrasive elements or a conversion of the device to another kind of processing with other abrasive elements is easily performed. Suitable kinds of abrasive elements are described in, e.g., WO-A-01/76824.

Furthermore, holding elements may be arranged between the abrasive elements in order to limit the deflection of the abrasive means. The effect of the holding elements is that the abrasive means at a certain deflection thereof become engaged with the holding element at the back, which results in an increased stiffness of the abrasive means and thereby requires greater force for further deflection. The holding elements preferably comprise a holding brush having a shorter length than the abrasive elements and which is mounted in a profile rail, which is received in a corresponding undercut groove on the face of the abrading disc.

The means for driving the rotation of the abrading discs is normally arranged in such a way that all abrading discs are rotated the same way. However, it is also an option according to the present invention that adjacent abrading discs are rotated in the opposite direction which in combination with the reciprocatory movement of the abrading discs results in a more uniform abrasion of all parts of the item surface.

The plurality of abrading discs may preferably be arranged so that they are aligned transversely to the direction of feed of the items. In a further preferred embodiment, the plurality of abrading discs are arranged in two consecutive rows transversely to the direction of feed of the items, wherein the discs in one row are staggered with respect to the discs in the other row. In the latter arrangement, the length of stroke may be reduced and is preferably a magnitude of 20–50%, preferably 30–43%, of the diameter of the discs.

The abrading device, according to the invention, may further comprise at least one abrading cylinder, preferably two opposite rotating abrading cylinder, which are arranged to abrade a side of the item, and which preferably comprises abrasive means extending substantially radially from an elongated core, said abrading cylinder(s) extending transversely to the direction of feed and is/are driven to rotate about their longitudinal axes. Preferably, the at least one abrading cylinder is arranged after said side has been abraded by the abrading discs but may alternatively be arranged before, so that the items meet the cylinder prior to the abrading discs. An abrasion with rotating abrading discs can be relatively aggressive as there will be some transversal abrasion of the items and the device is typically designed for a relatively high abrasion pressure and low rotational speeds of the abrading disc in order not to deform possible shapings in the work piece. Thus, some "wild" abrasive scratches will occur due to the rotation but these will be removed by the one, two or more abrading cylinder, which will, typically, be equipped with a rougher grit size than the abrading discs. Alternatively, the machine may be constructed with an extra similar module with a plurality of abrading discs in order to leave out the abrading cylinders.

The different possible features of embodiments of the present invention discussed above may be mutually combined within the invention to form advantageous embodiments thereof.

BRIEF DESCRIPTION OF THE DRAWINGS

Preferred embodiments of an abrading device according to the invention is described in the following with reference to the enclosed drawing in which.

DETAILED DESCRIPTION OF THE INVENTION

In the following, a preferred embodiment of an abrading device according to the invention is described as an example and illustration of the invention. The example does not serve to limit the invention and from the description and the claims, the skilled person will be able to embody a number of alternative devices, which will all be within the scope of the invention.

Figure 1:
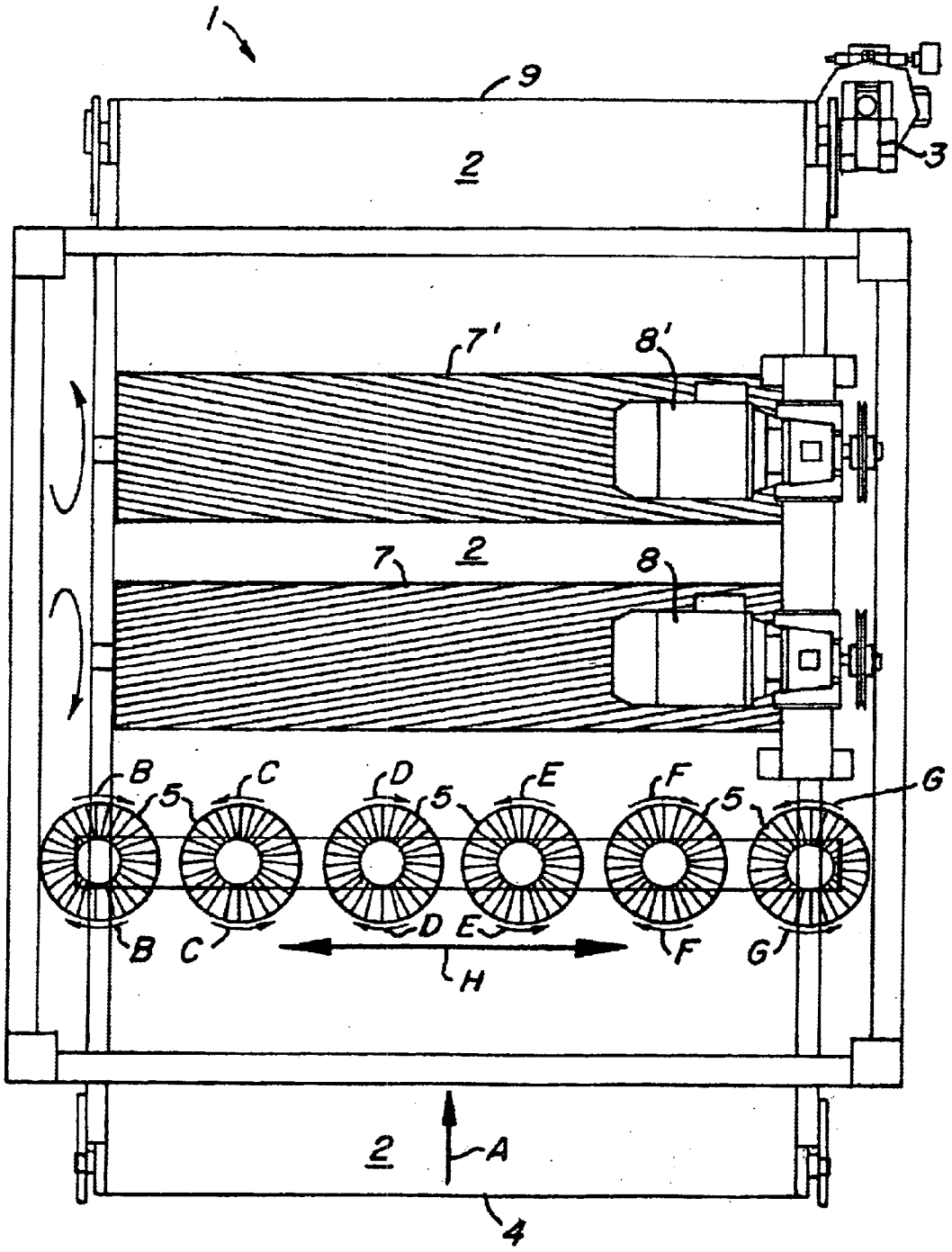
FIG. 1 illustrates the abrading device seen from above with some parts left out so that the abrasive parts are visible.

The abrading device 1 comprises a conveyor belt 2 driven continuously or stepwise by a motor 3 and is used to convey substantially plane items through the abrading device 1 from a feed end 4 in a direction of feed indicated by the arrow A on FIG. 1. Hereafter, the upper side of the item contacts with six abrading discs 5 arranged in a row which is transversal in relation to the direction of feed of the item and where the abrading discs 5 are rotated clockwise and counter-clockwise alternately such that two adjacent abrading discs 5 are rotated in separate directions as indicated by the arrows B–G on FIG. 1. Alternatively, the drive of the abrading discs 5 may also be arranged such that all the abrading discs 5 rotate in the same direction.

The abrading discs 5 are mounted on a slide 10 which during operation is moved in a reciprocatory movement as indicated by the arrow H on FIG. 1, where the movement has a length of stroke so that the extreme positions of each of the abrading discs 5 center positions in the reciprocatory movement are situated with a mutual distance of 75% of the diameter of the abrading discs 5.

Figure 6:
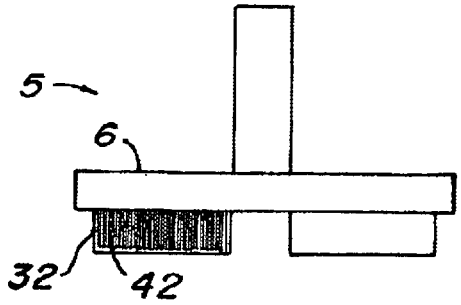
FIG. 6 illustrates a schematic side view of an abrading disc of the invention.
Figure 7:
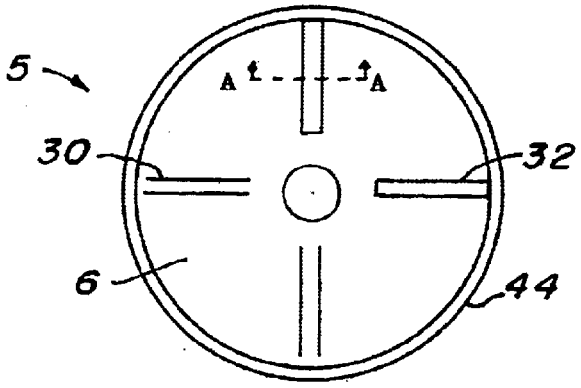
FIG. 7 illustrates a bottom view of the abrading disc of FIG. 6.
Figure 8:
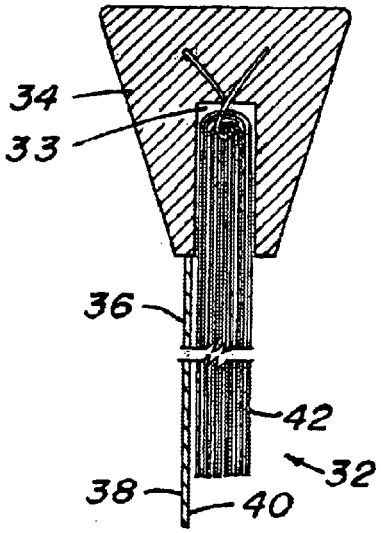
FIG. 8 illustrates an enlarged, partial cross-section of the abrading disc of FIG. 7 taken along line A—A.

Each abrading disc 5 comprises a disc 6 which, on the bottom side facing down towards the item, has a plurality of undercut, radially running grooves 30 (see, particularly, FIGS. 6–8) in which abrasive elements 32 are received comprising a profile rail 34 which retains in a channel 33 a number of abrasive lamellae 36 of which the front side 38 has abrasive properties and of which the back side 40 is supported by a number of support brushes 42. The abrasive lamellae 36 extend downwards from the disc 6 towards the item substantially perpendicular to the rotation plane of the disc 6. A suitable type of such abrasive lamellae comprising a profile rail, abrasive lamellae and brushes is, e.g., described in WO-A-01/76824. The abrasive elements 32 are orientated in such a way that the front side of the abrasive elements 32 with the abrasive properties are at the front in the rotational direction. The abrasive elements 32 are secured on the disc by the interaction between the profile rail 34 and the undercut grooves 30 having a dovetailed cross section of the opening, and by a ring 44, which extends around the periphery of the disc 6 and closes the open end of the rails at the periphery of the disc. This ring 44 is removable after which the abrasive elements 32 can be pushed out of the grooves 30 and new abrasive elements 32 can be pushed in.

Figure 9:
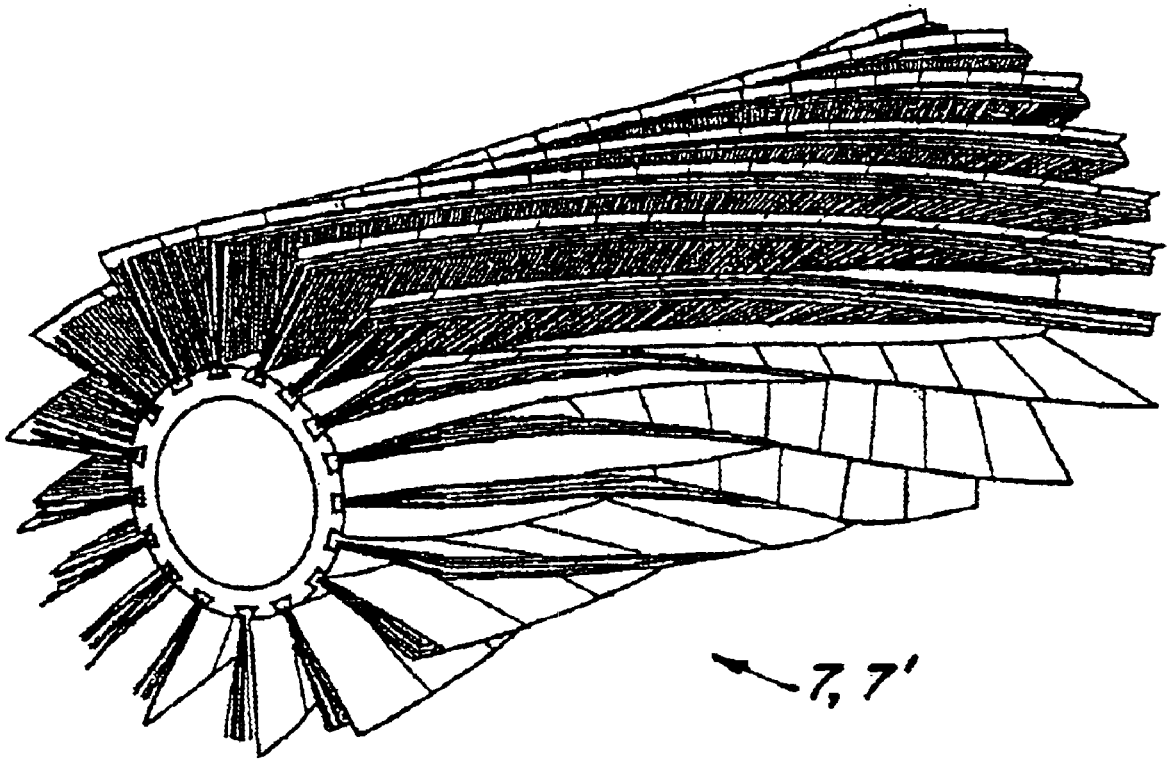
FIG. 9 illustrates an abrading cylinder in one embodiment of the invention.

After having passed the abrading discs 5 the items are transported further on the conveyor belt 2 under two opposite rotating abrading cylinders 7, 7' which remove possible scratches in the surface of the items and give the surface the final finish. The abrading cylinders 7, 7' are driven by associated motors 8, 8'. Suitable abrading cylinders are, e.g., described in WO-A-01/76824. The abrading cylinders 7, 7' are shown in one exemplary embodiment in FIG. 9. Thereafter, the conveyor belt 2 conveys the items out of the abrading device at its exit end 9.

Figure 2:
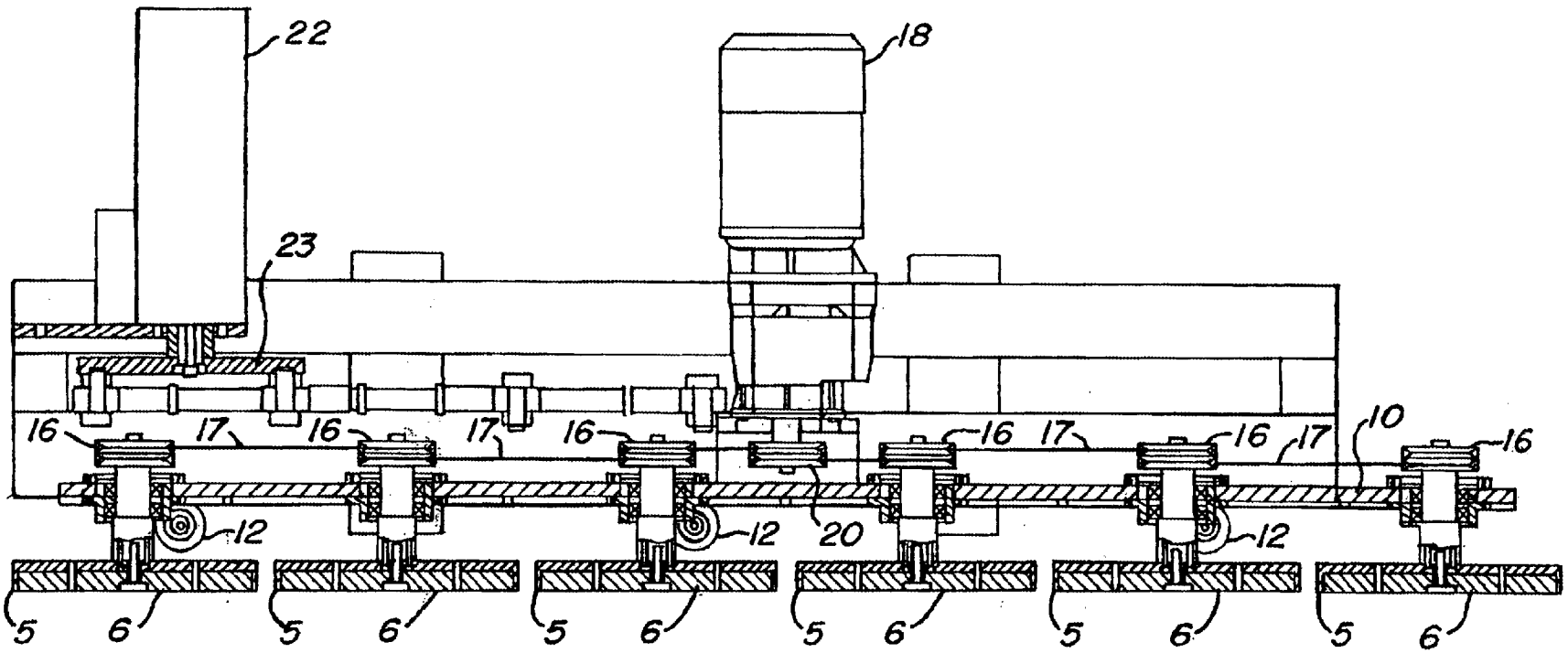
FIG. 2 illustrates a part of the abrasive device seen from the feed end in a perpendicular section through the abrading discs; in which the abrading discs, their slide and the drive are illustrated.
Figure 3:
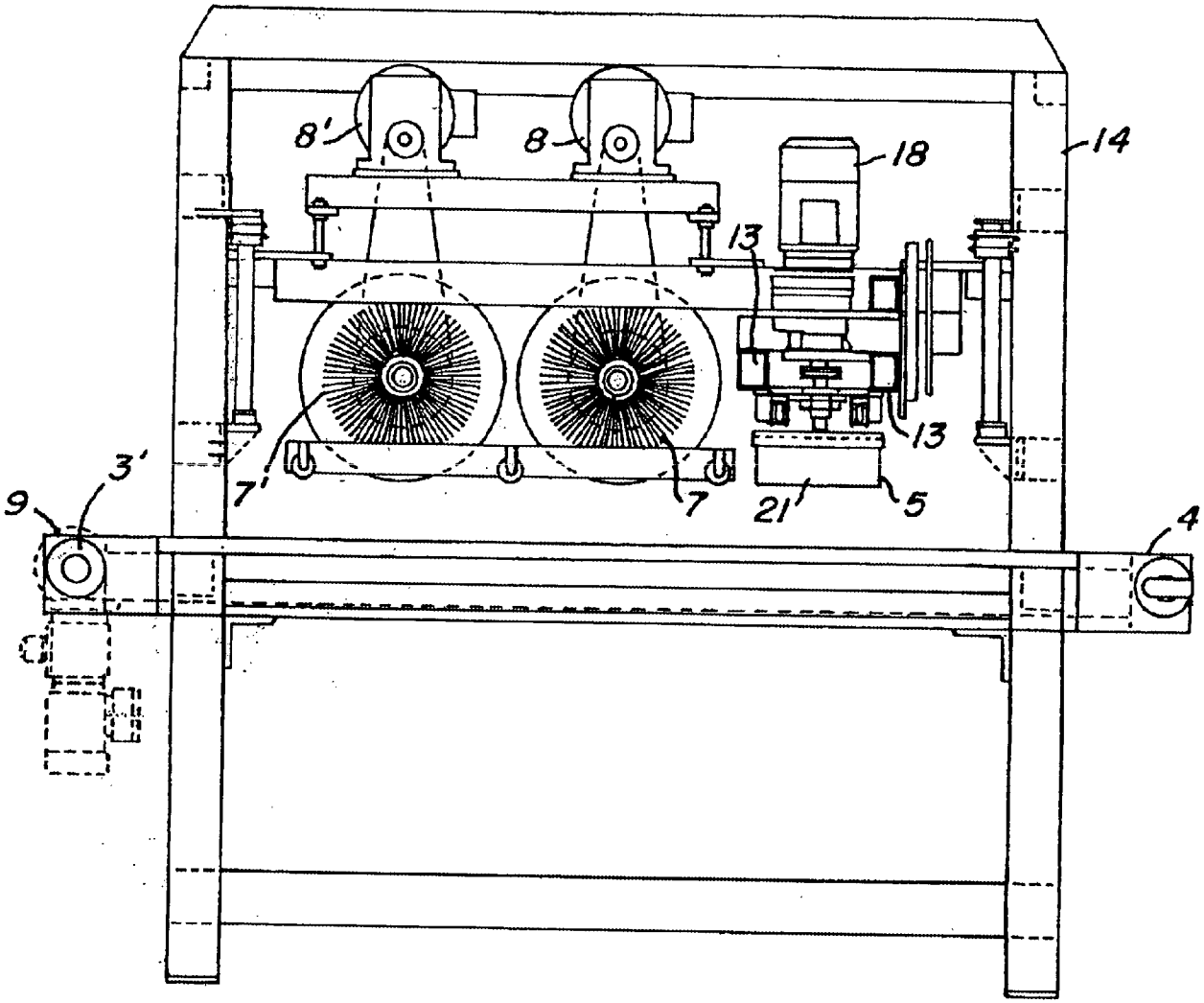
FIG. 3 illustrates the abrading device seen from the side in a perpendicular section.
Figure 4:
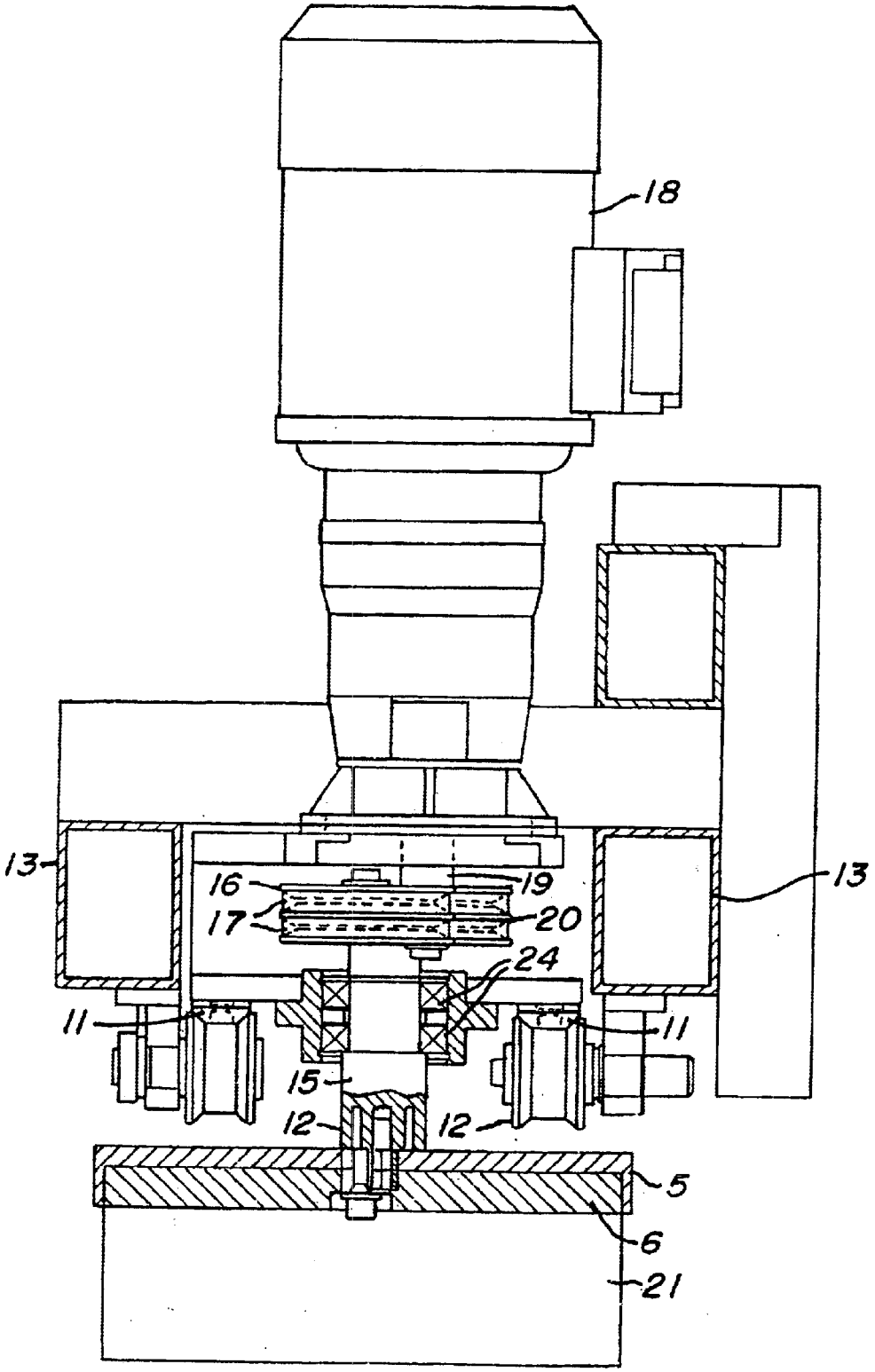
FIG. 4 illustrates an abrading disc, the slide of the abrading discs and their suspension and drive seen from the side in a partly section.

As shown in FIGS. 2–4 the abrading discs 5 are mounted on a common slide 10 which is movable in transverse direction in relation to the direction of feed of the items in as much as the slide 10 comprises two rails 11 that run in three sets of wheels 12 which are securely mounted on a transverse beam 13 which is secured to the frame 14 of the abrading device 1. Each abrading disc 5 is mounted on a vertical axle 15, which is embedded in the slide 10 with bearings 24 such that it turns freely about its vertical axis with minimal friction. The axle 15 extends through the slide 10 and has at its upper end a pulley 16 to cooperate with a v-belt 17 for driving the rotation of the abrading discs 5. All abrading discs 5 are driven by a motor 18 mounted on the slide 10, which has a pulley 20 mounted on its driving axle 19. On FIGS. 3 and 4 the extension 21 of the abrasive lamellae in vertical direction is indicated.

The reciprocatory movement of the slide 10 transverse to the direction of feed of the items is driven by a separate motor 22 via an eccentric mechanism 23.

Figure 5:
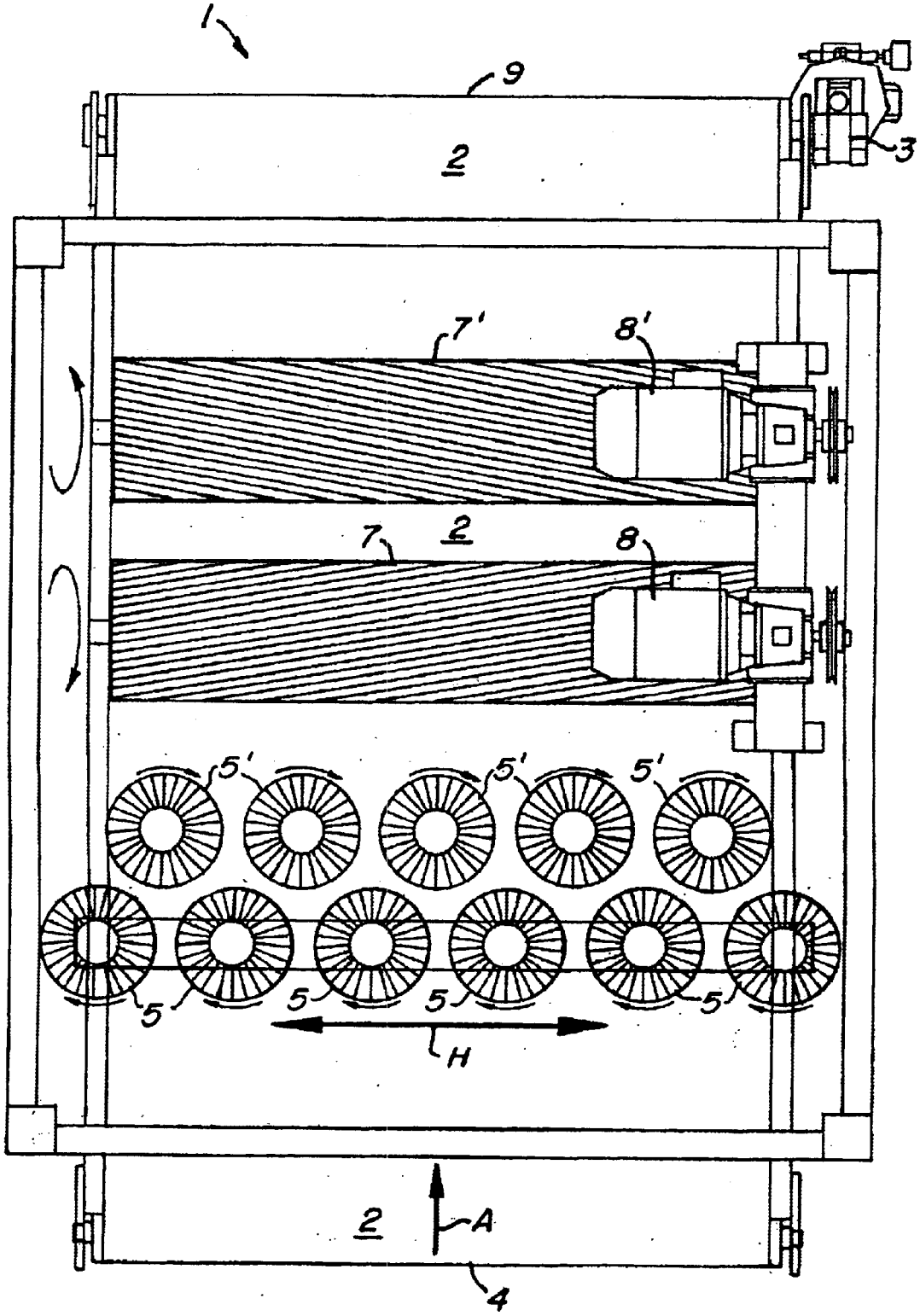
FIG. 5 illustrates a second embodiment of the present invention.

The embodiment shown in FIG. 5, the abrading discs 5, 5' are arranged in two successive rows transversely to the direction of feed A of the items, and the discs 5 in the first row are staggered with respect to the discs 5' in the second row. All the discs 5, 5' are arranged on a common slide 10 which, due to the staggered arrangement, during operation is moved in a reciprocatory movement as indicated by the arrow H on FIG. 1, with a length of stroke of about half of the magnitude of the embodiment shown in FIG. 1, i.e. the extreme positions of each of the abrading discs 5, 5' center positions in the reciprocatory movement are situated with a mutual distance of about 35–40% of the diameter of the abrading discs 5, 5'.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An abrading device for abrasion of substantially plane items, said device comprising:

means for conveyance of the substantially plane items in a direction of feed;

suspension means for suspension of a plurality of abrading discs having abrasive means for abrasion of a side of the substantially plane items, wherein the plurality of abrading discs have undercut grooves for reception and fixing of profile rails which form a part of clongated abrasive elements comprising the abrasive means, said grooves preferably extend in a mainly radial direction on a face of the abrading disc;

means for driving rotation of the abrading discs around axes, which are substantially perpendicular to the side of the substantially plane items; and means for driving the abrading discs in a reciprocatory movement transverse to the direction of feed of the substantially plane items.

2. An abrading device according to claim 1, wherein the abrasive means extends outwards from a face of the abrading discs.

3. An abrading device according to claim 1, wherein the abrading discs are arranged aligned transversely to the direction of feed of the substantially plane items.

4. An abrading device according to claim 1, wherein the reciprocatory movement of the abrading discs has a length of stroke of 40–100% of a diameter of the discs.

5. An abrading device according to claim 4, wherein the reciprocatory movement of the abrading discs has a length of stroke of 60–85% of the diameter of the discs.

6. An abrading device according to claim 1, wherein the abrading discs are arranged aligned in two successive rows transversely to the direction of feed of the substantially plane items, the discs in one row being staggered with respect to the discs in the other row.

7. An abrading device according to claim 6, wherein the reciprocatory movement of the abrading discs has a length of stroke of 20–50% of a diameter of the discs.

8. An abrading device according to claim 7, in which the reciprocatory movement of the abrading discs has a length of stroke of 30–43% of the diameter of the discs.

9. An abrading device according to claim 1, wherein the abrading discs with abrasive means comprise abrasive lamellae of an abrasive sheet of which the front side has abrasive properties and which extend from a face of the abrading disc.

10. An abrading device according to claim 9, wherein the abrasive means comprise an elastic support element which support a backside of the abrasive lamellae, said support element substantially having a same length as the lamellae.

11. An abrading device according to claim 9, wherein the abrasive means are arranged in elongated abrasive elements extending primarily in radial direction on faces of the abrading discs.

12. An abrading device according to claim 11, wherein the abrasive elements comprise profile rails in which the abrasive means are attached and which are received in undercut grooves in the abrading discs.

13. An abrading device according to claim 11, wherein holding elements are arranged between the abrasive elements.

14. An abrading device according to claim 13, wherein each of the holding elements comprises a holding brush having a shorter length than the abrasive elements and which is mounted in a profile rail arranged in an undercut groove.

15. An abrading device according to claim 1, further comprising at least one abrading cylinder, which is arranged to abrade a side of the item and which comprises abrasive means extending substantially radially from an elongated core, said abrading cylinder extends transversely to the direction of feed and is driven to rotate about its longitudinal axis.

16. An abrading device according to claim 15, wherein the at least one abrading cylinder is arranged after the abrading discs in the direction of feed of the substantially plane items.

17. An abrading device for abrasion of substantially plane items, said device comprising:

a conveyer belt for moving the substantially plane items in a direction of feed;

a common slide;

a plurality of abrading discs mounted on the common slide, the discs including abrasive elements for abrading a side of the substantially plane items, wherein the plurality of abrading discs have undercut grooves for reception and fixing of profile rails which form a part of the elongated abrasive elements, said grooves preferably extend in a mainly radial direction on a face of the abrading disc;

a first motor for driving rotation of the abrading discs around axes, which are substantially perpendicular to the side of the substantially plane items; and a second motor for driving the abrading discs in a reciprocatory movement transverse to the direction of feed of the substantially plane items.

18. An abrading device according to claim 17, wherein the abrasive elements extend outwards from a face of the abrading discs.

19. An abrading device according to claim 17, wherein the abrading discs are arranged aligned transversely to the direction of feed of the substantially plane items.

20. An abrading device according to claim 17, wherein the reciprocatory movement of the abrading discs has a length of stroke of 40–100% of a diameter of the discs.

21. An abrading device according to claim 19, wherein the reciprocatory movement of the abrading discs has a length of stroke of 60–85% of the diameter of the discs.

22. An abrading device according to claim 17, wherein the abrading discs are arranged aligned in a plurality of successive rows transversely to the direction of feed of the substantially plane items, the discs in one row being staggered with respect to the discs in another row.

23. An abrading device according to claim 22, wherein the reciprocatory movement of the abrading discs has a length of stroke of 20–50% of a diameter of the discs.

24. An abrading device according to claim 23, in which the reciprocatory movement of the abrading discs has a length of stroke of 30–43% of the diameter of the discs.

25. An abrading device according to claim 17, wherein the abrasive elements comprise abrasive lamellae of an abrasive sheet of which the front side has abrasive properties and which extend from a face of the abrading disc.

26. A An abrading device according to claim 25, wherein the abrasive elements comprise an elastic support element which support a backside of the abrasive lamellae, said support element having substantially a same length as the lamellae.

27. An abrading device according to claim 25, wherein the abrasive elements are elongated elements arranged primarily in a radial direction on faces of the abrading discs.

28. An abrading device according to claim 27, wherein the abrasive elements comprise profile rails in which the abrasive elements are attached and which are received in undercut grooves in the abrading discs.

29. An abrading device according to claim 27, wherein holding elements are arranged between the abrasive elements.

30. An abrading device according to claim 29, wherein each of the holding elements comprises a holding brush that displays a shorter length than the abrasive elements and which is mounted in a profile rail arranged in an undercut groove.

31. An abrading device according to claim 17, further comprising at least one abrading cylinder, which is arranged to abrade a side of the item and which comprises abrasive elements extending substantially radially from an elongated core, said abrading cylinder extends transversely to the direction of feed and is driven to rotate about its longitudinal axis.

32. An abrading device according to claim 31, wherein the at least one abrading cylinder is arranged after the abrading discs in the direction of feed of the substantially plane items.

* * * * *